US008172965B2

(12) United States Patent
Daoud et al.

(10) Patent No.: US 8,172,965 B2
(45) Date of Patent: May 8, 2012

(54) EXPLOSIVE COMPOSITIONS AND METHODS FOR FABRICATING EXPLOSIVE COMPOSITIONS

(75) Inventors: Sami Daoud, New Hope, PA (US); Thomas R. Berger, Tucson, AZ (US); Michael J. Villeburn, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 294 days.

(21) Appl. No.: 12/579,202

(22) Filed: Oct. 14, 2009

(65) Prior Publication Data

US 2011/0083776 A1 Apr. 14, 2011

(51) Int. Cl.
*C06B 25/00* (2006.01)
*D03D 23/00* (2006.01)
*D03D 43/00* (2006.01)

(52) U.S. Cl. ..... 149/88; 149/109.2; 149/109.4

(58) Field of Classification Search ..... 149/12, 149/88, 109.2, 109.4
See application file for complete search history.

(56) References Cited

U.S. PATENT DOCUMENTS

| | | | | |
|---|---|---|---|---|
| 5,183,520 | A * | 2/1993 | Wanninger et al. | 149/19.91 |
| 6,635,131 | B2 * | 10/2003 | Blomquist et al. | 149/99 |
| 6,673,174 | B2 * | 1/2004 | Daoud | 149/92 |
| 2002/0003016 | A1 | 1/2002 | Ampleman et al. | |
| 2003/0062103 | A1 * | 4/2003 | Daoud | 149/19.91 |
| 2005/0067070 | A1 * | 3/2005 | Koch | 149/19.3 |
| 2006/0252852 | A1 | 11/2006 | Braun et al. | |
| 2008/0248201 | A1 | 10/2008 | Corkery et al. | |
| 2009/0036568 | A1 | 2/2009 | Merle et al. | |
| 2009/0078346 | A1 | 3/2009 | Cohen-Arazi et al. | |

FOREIGN PATENT DOCUMENTS

| | | | |
|---|---|---|---|
| WO | 2008148128 | A2 | 12/2008 |
| WO | 2009055772 | A1 | 4/2009 |
| WO | 2009115671 | A1 | 9/2009 |

OTHER PUBLICATIONS

European Patent Office, International Searching Authority, "International Search Report" mailed Dec. 14, 2010; International Application No. PCT/US2010/038760, filed Jun. 16, 2010.

Cho, S. H. et al. "Polydimethylsiloxane-Based Self-Healing Materials," Advanced Materials, Wiley VCH Verlag, DE, pp. 997-1000, XP002511055, ISSN: 0935-9648, DOI: 10.1002/ADMA.200501814; 2006.

Eaton, P. E. et al. "Polynitrocubanes: Advanced High-Density, High-Energy Materials," Advanced Materials 20000802 Wiley7-VCH Verlag Berlin GMBH, vol. 12, No. 15, Aug. 2, 2000, pp. 1143-1148, XP000963578, DOI: 10.1002/1521-4095(200008)12:15<1143::A.

Talawar, M. B. et al. "Novel Ultrahigh-Energy Materials," Combustion, Explosion and Shock Waves May 2005 Kluwer Academic/Plenum Publishers US, vol. 41, No. 3, May 2005, pp. 264-277, XP002612124, DOI: 10.1007/S10573-005-0031-1.

* cited by examiner

*Primary Examiner* — James McDonough
(74) *Attorney, Agent, or Firm* — Cantor Colburn LLP

(57) ABSTRACT

PBX compositions and methods for fabricating PBX compositions are provided. In an exemplary embodiment, a PBX composition comprises a binder matrix comprising a thermoset resin and an oxidizer comprising octanitrocubane (ONC), the oxidizer homogeneously dispersed within the binder matrix. In another embodiment, a method for fabricating a PBX composition comprises providing an oxidizer comprising octanitrocubane (ONC) and blending the oxidizer with a prepolymer that, upon cure, forms a thermoset resin.

8 Claims, 2 Drawing Sheets

EXPLOSIVE COMPOSITIONS AND METHODS FOR FABRICATING EXPLOSIVE COMPOSITIONS

FIELD OF THE INVENTION

The present invention generally relates to explosive compositions and methods for fabricating explosive compositions and, more particularly, relates to plastic bonded explosive (PBX) compositions and methods for fabricating PBX compositions.

BACKGROUND OF THE INVENTION

A plastic-bonded explosive, also called a PBX or a polymer-bonded explosive, generally contains an energetic "oxidizer" homogeneously dispersed in a matrix of a synthetic thermoset polymer or a "binder matrix". In this form, the PBXs exhibit "insensitive munitions" (IM) properties, which render them capable of withstanding sympathetic detonation as a result of mechanical shocks, fire, electrostatic discharge, and impact by shrapnel, yet are still capable of high-order detonation per design intent. These PBXs are referred to as IM-based explosives. Conventional PBXs typically comprise oxidizers such as HMX (or "high melting point explosive"), chemically known as cyclotetramethylene tetranitramine, RDX (or "royal demolition explosive"), chemically known as cyclotrimethylene trinitramine, C1-20, chemically known as 2,4,6,8,10,12-hexanitro-2,4,6,8,10,12-hexaazaisowurtzitane, or combinations thereof.

However, conventional PBXs suffer from several shortcomings. Conventional PBXs often suffer from short service life due to mechanical, thermal and/or ballistic degradation caused by exposure to extreme environments, such as high temperature, moisture, or a synergistic effect of both over time. Many conventional PBXs do not exhibit robust performance post-exposure beyond twenty years. In addition, many PBXs contain plasticizers, which are added to the explosive formulation as a processing aid. Over time, these plasticizers can migrate or diffuse from within the binder matrix to the surface of the PBX or to other locations within the binder matrix, thus compromising explosive properties. This diffusion results in increased hardness of the explosive charge, noticeable shrinkage, and in extreme cases noticeable degradation in mechanical properties, leading to collapse of the charge as a result of loss of binder support (catastrophic failure).

In addition, as warfare technology advances, there is a continuing drive to develop PBXs that offer significant explosive output and superior brisance compared to existing explosives. This translates into PBXs that have far superior detonation velocity coupled with far superior detonation pressure compared to conventional PBXs. With this drive for higher energy density has come the desire for PBXs with improved IM properties that prevent or minimize the danger that the PBXs will detonate accidentally upon inadvertent shock, impact, electrostatic discharge, and the like.

Accordingly, it is desirable to provide PBXs with improved explosive output and improved IM properties. In addition, it is desirable to provide PBXs with improved service life. It is also desirable to provide PBXs that offer minimal or no plasticizer migration. In addition, it is desirable to provide methods for fabricating such PBXs. Furthermore, other desirable features and characteristics of the present invention will become apparent from the subsequent detailed description of the invention and the appended claims, taken in conjunction with the accompanying drawings and this background of the invention.

BRIEF SUMMARY OF THE INVENTION

PBX compositions and methods for fabricating PBX compositions are provided herein. In accordance with an exemplary embodiment, a PBX composition comprises a binder matrix comprising a thermoset resin and an oxidizer comprising octanitrocubane (ONC), the oxidizer homogeneously dispersed within the binder matrix.

In accordance with another exemplary embodiment, a PBX composition comprises a binder matrix comprising a thermoset resin, an oxidizer, and first structures comprising a first material and second structures comprising a second material. The first material and second material are of compositions such that, upon combination, the first material and the second material form a polymer. The oxidizer, the first structures, and the second structures are homogeneously dispersed throughout the binder matrix.

In accordance with a further exemplary embodiment, a method for fabricating a PBX composition comprises providing an oxidizer comprising octanitrocubane (ONC) and blending the oxidizer with a prepolymer that, upon cure, forms a thermoset resin.

BRIEF DESCRIPTION OF THE DRAWINGS

The present invention will hereinafter be described in conjunction with the following drawing figures, wherein like numerals denote like elements, and wherein.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The various embodiments contemplated herein relate to plastic-bonded explosive compositions that exhibit superior explosive output and improved IM properties compared to conventional PBX compositions. In particular, various embodiments contemplated herein are directed to a PBX composition comprising a binder matrix and an oxidizer comprising octanitrocubane (ONC). In addition, various embodiments are directed to PBX compositions with controlled-release self-healing mechanisms that permit service lives of up to and/or beyond 50 years. Further, various embodiments are directed to PBX compositions that comprise plasticizers with low molecular weight and high viscosity such that the plasticizers exhibit minimal or no diffusion through a binder matrix.

Figure 1:
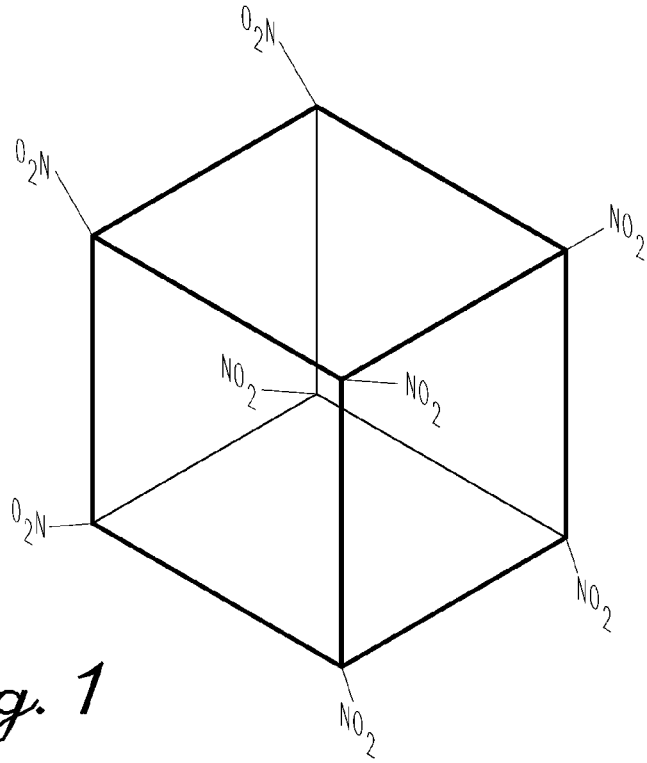
FIG. 1 is a schematic illustration of the molecular structure of octanitrocubane (ONC)

As noted above, in one exemplary embodiment of the present invention, the PBX composition contains an oxidizer comprising ONC. ONC has the empirical formula $C_8N_8O_{16}$ and the structure illustrated in FIG. 1. The heat of formation of ONC is about +163 kilocalories per mole (Kcal/mole) and the theoretical density of ONC is in the range of about 1.92 to about 2.2 g/cm$^3$. Important factors in determining explosive output are the heat of formation and the theoretical density, as the Velocity of Detonation (VOD) is directly proportional to the square of the theoretical density and the detonation pressure ($P_{CJ}$) is proportional to the theoretical density. ONC is a powerful non-nuclear explosive with superior energy density compared to HMX (theoretical density of 1.86-1.91 grams per cubic centimeter (g/cm$^3$)), RDX (theoretical density of 1.80-1.82 g/cm$^3$), and C1-20 (theoretical density of 1.90-2.04 g/cm$^3$). In this regard, an ONC-based PBX composition comprising ONC and a thermoset resin has a VOD of about 9-11 kilometers per second (km/s), which is about 11-23% greater than that of a comparable HMX-based composition (about 8.5-9.8 km/s). Further, an ONC-based PBX composition has a $P_{CJ}$ of about 465-625 kilobars, about 34% greater than the $P_{CJ}$ of a comparable HMX-based PBX composition (about 396.3 kilobars).

ONC has a zero "oxygen balance" and therefore is capable of complete combustion in the absence of air under ideal conditions. "Oxygen balance" is a ratio of the amount of oxygen in an explosive to the amount of oxygen needed for complete combustion, which dictates the extent of the combustion reaction and the composition of the by-products of the combustion or detonation. The fewer solid byproducts and the more moles of gas produced during combustion of an explosive, the greater the detonation pressure of the explosive. When synthesized stoichiometrically, ONC is a solid, white, granular powder that decomposes upon melting at a temperature of about 297° C. according to the following reaction scheme:

$$C_8(NO_2)_8 \rightarrow 8CO_2 + 4N_2,\ \Delta H \cong +163\ \text{Kcal/mole}.$$

Thus, because the byproducts of the combustion of ONC are carbon dioxide and nitrogen gases, and because of ONC's high positive heat of formation, ONC has superior detonation output compared to prior art explosives. In addition, ONC is markedly insensitive to shock, impact and electrostatic discharge and is thermally-stable when formulated into the PBX composition using temperatures of up to 350° C. In one exemplary embodiment, the PBX composition comprises ONC oxidizer in the range of about 80 to about 98 weight percent (wt. %) of the PBX composition.

The ONC is distributed homogenously throughout the binder matrix of the PBX composition and can be present in the PBX composition in one or various particle sizes. For example, in one embodiment, ONC is present as particles with substantially the same dimensions or sizes. In a second embodiment, the ONC is bimodal, having, for example, a blend of course ONC particles with a particle size distribution of about 150 to about 400 micrometers (μm) and fine particles with a particle size distribution of about 15 to about 45 μm. In a third embodiment, the ONC is bimodal, having a blend of course and fine particles in the ratio of about 5:2, respectively. In a fourth embodiment, the ONC is trimodal, having, for example, a blend of course ONC particles with a particle size distribution of about 150 to about 400 μm, fine particles with a particle size distribution of about 15 to about 45 μm, and ultrafine particles with a particle size distribution of about 1 to about 15 μm. In a fifth embodiment, the ONC is trimodal, having a blend of course, fine, and ultrafine particles in the ratio of about 5:3:2, respectively. Of course, the ONC particles may be present in any other sizes and size distributions suitable for a particular explosives application.

Depending on a desired explosives application, in addition to ONC, the oxidizer of the PBX composition may also comprise other oxidizers, such as HMX, RDX, C1-20, or combinations thereof. For example, in various explosives applications, it may be desirable to combine oxidizers that impart different characteristics, namely, ballistics properties coupled with mechanical properties, mechanical properties coupled with ease of processing properties, or consolidation characteristics coupled with particle size and hardness properties, etc. Alternatively, in other various explosives applications, it may be desirable to minimize cost of the PBX composition by using an oxidizing component that can be purchased at a lower price than ONC. In one embodiment, the oxidizer may comprise from about 15 to about 85 wt. % ONC and from about 85 to about 15 wt. % HMX. In a second embodiment, the oxidizer may comprise from about 15 to about 85 wt. % ONC and from about 85 to about 15 wt. % C1-20. In a third embodiment, the oxidizer may comprise from about 15 to about 85 wt. % ONC and from about 85 to about 15 wt. % RDX. In a fourth embodiment, the oxidizer may comprise from about 15 to about 85 wt. % ONC and from about 85 to about 15 wt. % aluminum. In a fifth embodiment, the oxidizer may comprise from about 15 to about 85 wt. % ONC and from about 85 to about 15 wt. % of any combination of HMX, RDX, C1-20, aluminum, and/or other oxidizers.

The various embodiments of the PBX composition also contain a binder matrix comprised of a thermoset synthetic resin. The binder matrix, in addition to allowing the PBX composition to be manipulated during fabrication into various shapes and forms, also serves as fuel for the detonation of the PBX composition. The binder matrix is the backbone component used in the PBX composition as it provides the skeletal structure for the explosive charge upon which the remaining constituents reside. The binder matrix can comprise energetic or inert synthetic resins. Examples of inert synthetic resins suitable for use in various embodiments of the PBX composition include, but are not limited to, polysulfone (PS), polyether sulfone (PES), polyphenyl sulfone (PPS), polyphenylene sulfide, polyaryl ketones, such as polyetherether ketone (PEEK), polyetherketone (PEK), and polyetherketoneketone (PEKK), polyisobutylene (PIB), hydroxyl-terminated polybutadiene (HTPB), carboxyl-terminated polybutadiene (CTPB), polybutadiene-acrylic acid-acrylonitrile (PBAN), polyurethanes, polyesters, polyimides, cellulose acetate (CA), cellulose acetate butyrate (CAB), ethylene vinyl acetate (EVA), and combinations thereof. Examples of energetic synthetic resins suitable for use in various embodiments of the PBX composition include, but are not limited to, glacidyl azide polymer (GAP), nitropolyurethanes, nitrocellulose, polyvinyl nitrate, and combinations thereof. In one preferred embodiment, the synthetic resin comprises polyisobutylene (PIB). In another preferred embodiment, the PBX composition comprises a synthetic resin in an amount of from about 2 to about 20 wt. % of the PBX composition.

In accordance with an exemplary embodiment, the PBX composition also comprises a plasticizer that imparts elastic/plastic properties to the binder matrix. The plasticizer may be an inert plasticizer or an energetic plasticizer. Examples of inert plasticizers suitable for use in the PBX composition include, but are not limited to, triacetin (TA), dioctyl adipate (DOA), dioctyl phthalate (DOP), diethyl phthalate (DEP), dibutyl phthalate (DBP), isodecyl pelargonate (IDP), tricresyl phosphate (TCP), and combinations thereof. Examples of energetic plasticizers suitable for use include, but are not limited to, n-butyl nena, methyl-ethyl nena, ethyl nena, bis-2,2-dinitropropyl fumarate (BDNPF), bis-2,2-nitropropyl acetate (BDNPA), nitroglycerin, metriol trinitrate/diethylene glycol dinitrate, diethylene glycol dinitrate, butanetriol trinitrate (BTTN), and combinations thereof. In addition to imparting elastic/plastic properties to the binder matrix, the plasticizers also can impart IM properties to the PBX composition. Examples of inert plasticizers that impart IM properties include DOA, DBP, TCP and IDP and examples of energetic plasticizers that impart IM properties include bis-2,2-dinitropropyl acetal and -formal (BDNPA/F), ethyl nena, methyl/ethyl nena, diisononyl adipate (DINA), diisononyl phthalate (DIANP), and n-butyl nena. In one exemplary embodiment, the plasticizer is present in the PBX composition in an amount of from about 1 to about 15 wt. % of the PBX composition. In a preferred embodiment, the plasticizer is energetic. Energetic plasticizers provide numerous benefits to the PBX composition. They enhance ballistic output, their extent of migration is near zero, and they impart processing benefits to the explosive formulation due to the existence of nitro groups in their backbone, thus providing good compatibility with the energetic oxidizer.

In a more preferred embodiment, the plasticizer comprises n-butyl nena. N-butyl nena has only one nitro group and, accordingly, is an energetic plasticizer with IM properties. In addition, due to its high viscosity and low molecular weight, n-butyl nena is substantially non-migrating throughout the binder matrix. Plasticizers often are not chemically bound to the resin of the binder matrix but, rather, are absorbed by the matrix forming strong electrokinetic forces. Over a long period of time, particularly when exposed to extreme environmental conditions, most plasticizers are lost from the surface periphery of the binder matrix by contact with air, liquids, or a secondary absorbent solid material. The lost plasticizer is replaced by migrating plasticizer from within the binder matrix, which replaces lost plasticizer via capillary diffusion. This diffusion and loss of plasticizer often results in reduced flexibility and often noticeable shrinkage of the PBX explosive charge. However, a sufficient amount of plasticizer can be retained in the bulk matrix if a plasticizer with low molecular weight and high viscosity is used. Essentially, the low molecular weight coupled with the high viscosity of the plasticizer work as a double-edge sword in eliminating capillary diffusion and, hence, migration out of the explosive matrix. N-butyl-nena has a lower molecular weight (207 g/gmole) compared to other plasticizers such as DOA (MW=258 g/gmole) and IDP (MW=446 g/gmole), while at the same time having a viscosity that is about 5 times that of IDP and about twice that of DOA. These properties render n-butyl nena substantially non-diffusing through the binder matrix compared to DOA and IDP.

In accordance with another exemplary embodiment, the PBX composition comprises a self-healing mechanism that imparts a unique mechanism of repairing micro- and macro-structural damage within the polymeric explosive matrix, and therefore provides extended longevity to the explosive charge. In certain embodiments, the service life of the PBX compositions contemplated herein can be extended from about 20 years for a conventional explosive to 50 years and beyond. Generally, the self-healing mechanism utilizes structures that carry at least a first monomer as a polymer precursor (hereinafter, a "monomer precursor") and either a second monomer precursor, a catalyst and/or a coupling agent, or a combination thereof. Should the PBX composition undergo cracking, crack propagation, or degradation within the matrix, the structures collapse due to external thermal, dynamic, or mechanical stresses, or a combination thereof, releasing their contents, which react in the presence of the catalyst or the coupling agent, forming a polymeric structure. The polymeric structure fills voids and cracks within the matrix, thus preventing inadvertent catastrophic initiation of the PBX composition that otherwise may result from the collapse of the oxidizer particles or friction between oxidizer particles along the planes of the cracks.

Figure 2:
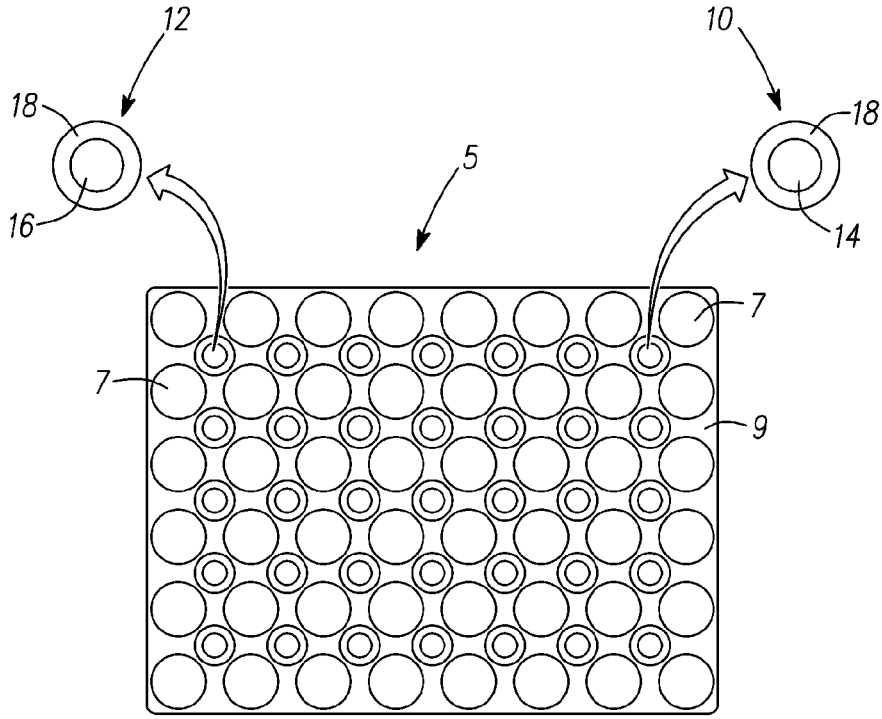
FIG. 2 is a schematic illustration of a binder matrix of a PBX composition with hollow spheres distributed throughout the matrix, in accordance with an exemplary embodiment.

In one exemplary embodiment, as illustrated in FIG. 2, the structures of the self-healing mechanism of a PBX composition 5 comprising ONC 7 include polymeric, ceramic, or glass hollow nanospheres and/or microspheres 10 and 12 that encapsulate or otherwise comprise at least two monomer precursors 14 and 16. One example of suitable hollow spheres includes those made from sodium borosilicate, although other suitable materials such as urea-formaldehyde also may be used. The hollow spheres comprising the first monomer precursor may be of varying size or may be of the same size. The hollow spheres comprising the second monomer precursor also may be of varying size or may be of the same size. The monomer precursors can be selected based on the chemical composition of the thermoset resin binder of the explosive matrix. For example, when the thermoset resin is polyurethane, a first set of the hollow spheres may encapsulate or otherwise comprise a hard segment monomer precursor, such as an isocyanate group, and a second set of hollow spheres may encapsulate or otherwise comprise a soft segment monomer precursor, such as a hydroxyl-containing group. In this regard, upon cracking or opening of the hollow spheres, the first monomer precursor and the second monomer precursor are released and combine to form a polymer, such as polyurethane, that fills the voids and/or cracks in the binder matrix. Examples of other precursors suitable for use include monomers such as methyl methacrylate (MMA), polydimethyl siloxane (PDMS), low-molecular weight epoxy resin, polyoxymethylene urea (PMU), dicyclopentadiene (DCPD), and the like.

In another exemplary embodiment, one or both sets of the hollow spheres may have a surface overcoat 18 comprising a catalyst and/or coupling agent that activates and/or facilitates the reaction of the first monomer precursor and the second monomer precursor. Examples of catalysts and/or coupling agents suitable for use include, but are not limited to, ferric acetyl acetonate (FeAA), gamma amino propyl triethoxysilane, tertiary butyl peroctoate, dibutyl tin dilaurate, benzylidenebis (tricyclohexylphosphine) dichlororuthenium (Grubbs Catalyst), 2-methylimidazole/$CuBr_2$ complex, and the like. Activation of the polymer synthesis reaction also may be initiated or facilitated by thermal or thermomechanical stress.

By way of example, the first set of hollow spheres may encapsulate toluene 2,4-diisocyanate (TDI) and the second set of hollow spheres may encapsulate 1,4-butanediol. In this example, the first and second hollow spheres are present in the PBX composition in a ratio that yields an equivalent ratio of 0.9-1.1, respectively, upon reaction of the precursors. The first and/or second hollow spheres also may comprise a surface overcoat of dibutyl tin dilaurate (DBTDL). Thus upon cracking or opening of the hollow spheres, or upon secretion of the monomeric contents of the hollow spheres, the TDI and the 1,4-butanediol combine in the presence of the DBTDL to form polyurethane that fills the voids and/or cracks in the binder matrix of the explosive charge.

In another example, a first set of hollow spheres encapsulate hydroxyl-functionalized polydimethyl siloxane (HOPDMS) and a second set of hollow spheres comprise polydiethoxy siloxane (PDES). The first and/or second hollow spheres also may comprise a surface overcoat of DBTDL. Thus upon cracking or opening of the hollow spheres, or upon secretion of the monomeric contents of the hollow spheres, the HOPDMS and the PDES are released and combine in the presence of the DBTDL to form polydimethylethylsiloxane that fills the voids and/or cracks in the binder matrix.

In another exemplary embodiment, the structures of the self-healing mechanism include polymeric, ceramic, or glass hollow nanospheres or microspheres that encapsulate or otherwise comprise a monomer precursor and a catalyst. For example, a set of hollow microspheres formed of urea-formaldehyde may encapsulate dicyclopentadiene (DCPD) monomer and a set of hollow nanospheres formed of urea-formaldehyde may encapsulate benzylidenebis (tricyclohexylphosphine) dichlororuthenium (Grubbs Catalyst). Upon cracking or opening of the hollow spheres, or upon secretion of the monomeric contents of the hollow spheres, the DCPD and the Grubbs Catalyst are released and combine to form polymerized DCPD that fills the voids and/or cracks in the binder matrix.

Figure 3:
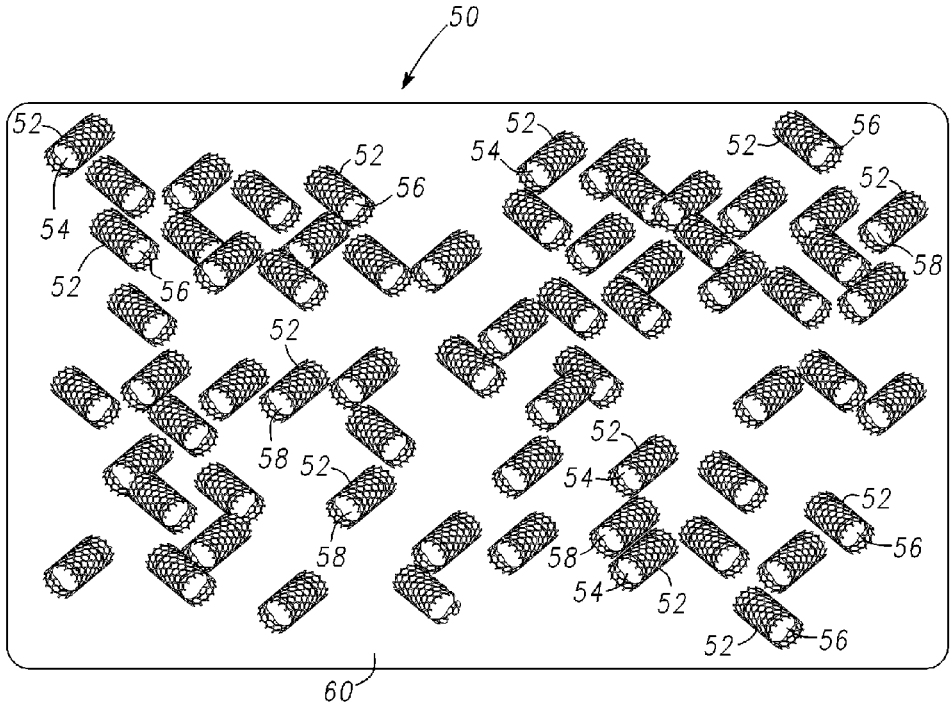
FIG. 3 is a schematic illustration of a binder matrix of a PBX composition with carbon nanotubes distributed throughout the matrix, in accordance with another exemplary embodiment.

In a further exemplary embodiment, as illustrated in FIG. 3, the structures of the self-healing mechanism of a PBX composition 50 include carbon nanotubes 52, such as, for example, single-walled carbon nanotubes (SWCNTs) or double-walled carbon nanotubes (DWCNTs). In one embodiment, a first set of SWCNTs are doped with or otherwise filled with a first monomer precursor 54, such as a hard segment monomer precursor, and a second set of SWCNTs are doped with or otherwise filled with a second monomer precursor 56, such as a soft segment monomer precursor. The first and/or second sets of SWCNTs can have a surface coat 58 comprising a catalyst and/or coupling agent that facilitates and/or activates the reaction of the monomer precursors. The first set and the second set of the SWCNTs can be present in the PBX composition 50 in a ratio that yields an equivalent ratio of 0.9-1.1, respectively, upon reaction of the precursors. In another embodiment, a first set of SWCNTs comprise a first monomer precursor, a second set of SWCNTs comprise a second monomer precursor, and a third set of SWCNTs comprise a catalyst and/or coupling agent. Upon exposure to thermal, mechanical, or dynamic stresses, or a combination thereof, the contents of the SWCNTs are released and combine to form a polymer, for example, of the same constituency as the binder matrix 60, but with significantly higher strength that is imparted by means of reinforcement by the SWCNTs. While the above-described exemplary embodiments utilize first structures and second structures that are of the same structure type and material, the invention is not so limited and the first structures can be of a type and/or material different from that of the second structures. For example, the first structures may be hollow spheres of sodium borosilicate and the second structures may be hollow spheres of urea-formaldehyde. Alternatively, the first structures may be of hollow spheres and the second structures may be of SWCNTs.

In addition to the above components, the PBX composition may comprise other components or additives. For example, the PBX composition may comprise an anti-oxidant stabilizer. Anti-oxidant stabilizers suitable for use in the PBX composition include, for example, AO-2246 (2.2'-methylenebis-(4-methyl-6-tertiary-butylphenol)) available from Western Reserve Chemical Corporation of Stow, Ohio. The PBX composition also may comprise fillers, such as sulfur and copper sulfate, that are compatible with the oxidizer, the thermoset binder, and the components of the self-healing mechanism, if present.

The following are exemplary embodiments of PBX compositions contemplated herein, with each of the components set forth in weight percent of the PBX composition. The examples are provided for illustration purposes only and are not meant to limit the various embodiments of the PBX compositions in any way.

EXAMPLE 1

| Ingredient | Wt. % |
|---|---|
| HTPB | 5.4 |
| ONC | 88.0 |
| N-butyl nena | 6.1 |
| Dicyclopentadiene | 0.5 |
| Total | 100.0 |

EXAMPLE 2

| Ingredient | Wt. % |
|---|---|
| HTPB | 4.0 |
| ONC | 85.0 |
| Aluminum | 6.2 |
| N-butyl nena | 4.3 |
| Dicyclopentadiene | 0.5 |
| Total | 100.0 |

EXAMPLE 3

| Ingredient | Wt. % |
|---|---|
| HTPB | 4.0 |
| ONC | 91.2 |
| N-butyl nena | 4.3 |
| Dicyclopentadiene | 0.5 |
| Total | 100.0 |

EXAMPLE 4

| Ingredient | Wt. % |
|---|---|
| Polyetherether ketone | 7.4 |
| ONC | 88.0 |
| N-butyl nena | 4.1 |
| Dicyclopentadiene | 0.5 |
| Total | 100.0 |

EXAMPLE 5

| Ingredient | Wt. % |
|---|---|
| Polyetherether ketone | 9.0 |
| ONC | 80.0 |

-continued

| Ingredient | Wt. % |
|---|---|
| Aluminum | 7.2 |
| N-butyl nena | 3.3 |
| Dicyclopentadiene | 0.5 |
| Total | 100.0 |

EXAMPLE 6

| Ingredient | Wt. % |
|---|---|
| Polyetherether ketone | 4.0 |
| ONC | 91.2 |
| N-butyl nena | 4.3 |
| Dicyclopentadiene | 0.5 |
| Total | 100.0 |

EXAMPLE 7

| Ingredient | Wt. % |
|---|---|
| Polyisobutylene | 7.4 |
| ONC | 88.0 |
| N-butyl nena | 4.1 |
| Dicyclopentadiene | 0.5 |
| Total | 100.0 |

EXAMPLE 8

| Ingredient | Wt. % |
|---|---|
| Polyisobutylene | 9.0 |
| ONC | 80.0 |
| Aluminum | 7.2 |
| N-butyl nena | 3.3 |
| Dicyclopentadiene | 0.5 |
| Total | 100.0 |

EXAMPLE 9

| Ingredient | Wt. % |
|---|---|
| Polyisobutylene | 7.4 |
| ONC | 88.0 |
| N-butyl nena | 4.1 |
| Dicyclopentadiene | 0.5 |
| Total | 100.0 |

EXAMPLE 10

| Ingredient | Wt. % |
|---|---|
| Polyurethane | 9.0 |
| ONC | 85.0 |
| N-butyl nena | 5.98 |
| Ferric actyl acetonate (FeAA) | 0.02 |
| Total | 100.00 |

EXAMPLE 11

| Ingredient | Wt. % |
|---|---|
| Polyurethane | 9.0 |
| ONC | 80.0 |
| Aluminum | 7.2 |
| N-butyl nena | 3.78 |
| Dibutyl tin dilurate (DBTDL) | 0.02 |
| Total | 100.00 |

EXAMPLE 12

| Ingredient | Wt. % |
|---|---|
| HTPB | 4.0 |
| ONC | 91.0 |
| N-butyl nena | 4.5 |
| Dicyclopentadiene | 0.5 |
| Total | 100.0 |

In this Example 12, the VOD was calculated at 10,193 meters per second and the PCJ was calculated to be 511 kilobars. The composition had an impact sensitivity measured at approximately 123 inches (as measured by ERL-type methodology), friction resistance measured at 412 Newtons, and electrostatic discharge resistance measured at 27 Joules.

The PBX compositions of the above Examples can be prepared by combining the ingredients in a heat-controlled homogenizing container, such as a Baker Perkin mixer, a V-shell blender, or a ribbon blender. For example, the oxidizer may be blended with a prepolymer that, upon cure, forms a thermoset resin. The ingredients can be mixed at room temperature or above, such as, for example, at 140-165° F. until the mixture is homogeneous, for example, for about 75-150 minutes. The PBX composition then can be vacuum cast or pressed into molds depending on subsystem weapon design requirements into a predetermined geometry, pressed into billets of desired size for packing, for example, into warheads, or vacuum cast into specialty-designed containers such as warhead cases or explosively-formed penetrator cases.

Accordingly, various embodiments of plastic-bonded explosives compositions that exhibit superior explosive output and improved IM properties compared to conventional PBXs have been provided. In particular, the various embodiments contemplated herein are directed to a PBX composition comprising a binder matrix and an oxidizer comprising octanitrocubane (ONC). In addition, various embodiments are directed to PBX compositions with controlled-release self-healing mechanisms that extend service lives of the PBX compositions up to and/or beyond 50 years. Further, various embodiments are directed to PBX compositions that comprise plasticizers with low molecular weight and/or high viscosity such that the plasticizers exhibit minimal or no diffusion.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A PBX composition comprising:

a binder matrix comprising a thermoset resin;

an oxidizer comprising octanitrocubane (ONC), the oxidizer homogeneously dispersed within the binder matrix; and first structures comprising a first material and second structures comprising a second material, wherein, upon combination, the first material and the second material form a polymer, and wherein the first structures are hollow spheres or single-walled carbon nanotubes and the first material is a monomer precursor.

2. The PBX composition of claim 1, wherein the oxidizer further comprises a material selected from the group consisting of HMX, RDX, Cl -20, aluminum, and combinations thereof.

3. The PBX composition of claim 1, wherein the binder matrix comprises a thermoset resin selected from the group consisting of polysulfone, polyether sulfone, polyphenyl sulfone, polyphenylene sulfide, polyaryl ketones, polyisobutylene, hydroxyl-terminated polybutadiene, carboxyl-terminated polybutadiene, polybutadiene-acrylic acid-acrylonitrile, polyurethanes, polyesters, polyimides, cellulose acetate, cellulose acetate butyrate, ethylene vinyl acetate, glacidyl azide polymer, nitropolyurethanes, polyvinylnitrate, and combinations thereof.

4. The PBX composition of claim 1, further comprising a plasticizer.

5. The PBX composition of claim 4, wherein the plasticizer comprises a material selected from the group consisting of triacetin, dioctyl adipate, dioctyl phathalate, diethyl phthalate, dibutyl phthalate, isodecyl pelargonate, tricresyl phosphate, n-butyl nena, methyl-ethyl nena, ethyl nena, bis-2,2-dinitropropyl fumarate (BDNPF), bis-2,2-nitropropyl acetate, nitroglycerin, metriol trinitrate/diethylene glycol dinitrate, diethylene glycol dinitrate, butanetriol trinitrate, and combinations thereof.

6. The PBX composition of claim 1, wherein the first structures encapsulate a first monomer precursor and the second structures encapsulate a second monomer precursor, and wherein the first monomer precursor and the second monomer precursor are the same monomer precursor or are different monomer precursors.

7. The PBX composition of claim 1, wherein the first structures encapsulate a monomer precursor and the second structures encapsulate a catalyst and/or coupling agent.

8. The PBX composition of claim 1, wherein the first structures comprise an overcoat of a catalyst and/or a coupling agent.

* * * * *